US009181677B2

(12) United States Patent
Saotome et al.

(10) Patent No.: US 9,181,677 B2
(45) Date of Patent: Nov. 10, 2015

(54) CONSTRUCTION MACHINE HAVING HYDRAULIC CIRCUIT

(75) Inventors: Yoshimi Saotome, Hiroshima (JP); Shota Oguma, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 464 days.

(21) Appl. No.: 13/813,171

(22) PCT Filed: Jul. 28, 2011

(86) PCT No.: PCT/JP2011/004263

§ 371 (c)(1),
(2), (4) Date: Jan. 30, 2013

(87) PCT Pub. No.: WO2012/017622

PCT Pub. Date: Feb. 9, 2012

(65) Prior Publication Data

US 2013/0129459 A1 May 23, 2013

(30) Foreign Application Priority Data

Aug. 3, 2010 (JP) ..... 2010-174361
Aug. 3, 2010 (JP) ..... 2010-174362

(51) Int. Cl.
*E02F 9/22* (2006.01)
*E02F 3/36* (2006.01)

(52) U.S. Cl.
CPC ..... *E02F 3/36* (2013.01); *E02F 9/2239* (2013.01); *E02F 9/2282* (2013.01); *E02F 9/2285* (2013.01); *E02F 9/2292* (2013.01); *F15B 2211/20576* (2013.01); *F15B 2211/3116* (2013.01)

(58) Field of Classification Search
CPC ..... E02F 9/2292; E02F 9/2239; F15B 2211/20576
USPC ..... 60/421, 486
See application file for complete search history.

(56) References Cited

U.S. PATENT DOCUMENTS 3,922,855 A * 12/1975 Bridwell et al. ..... 60/486
6,799,424 B2 * 10/2004 Ioku et al. ..... 60/486
2003/0089106 A1 5/2003 Ioku et al.

FOREIGN PATENT DOCUMENTS

| | | |
|---|---|---|
| JP | 11 217852 | 8/1999 |
| JP | 2001 182706 | 7/2001 |
| JP | 2003 148407 | 5/2003 |
| JP | 2005 121043 | 5/2005 |
| JP | 2009 57820 | 3/2009 |

OTHER PUBLICATIONS

International Search Report Issued Sep. 13, 2011 in PCT/JP11/04263 Filed Jul. 28, 2011.

* cited by examiner

*Primary Examiner* — Thomas E Lazo
(74) *Attorney, Agent, or Firm* — Oblon, McClelland, Maier & Neustadt, L.L.P.

(57) ABSTRACT

A construction machine includes a hydraulic actuator circuit including: a first circuit connected to one of travel motors and a boom cylinder; a second circuit connected to the other travel motor and arm cylinder; and a third circuit connected to a slewing motor; control valves for hydraulic actuators; and a merging valve having a first position for unloading hydraulic fluid discharged from a third pump upon no operation except for two travel motors; a second position for merging the hydraulic fluid into the first and second circuits upon a simultaneous operation of the travel motors and an operation of at least one remaining hydraulic actuator except for a boom raising operation; and a third position for merging the hydraulic fluid into the first circuit while blocking it from the second circuit upon the boom raising operation.

9 Claims, 4 Drawing Sheets

CONSTRUCTION MACHINE HAVING HYDRAULIC CIRCUIT

TECHNICAL FIELD

The present invention relates to a construction machine, such as a hydraulic shovel, which includes a lower propelling body, an upper slewing body, a working attachment, and a hydraulic circuit for driving them.

BACKGROUND ART

The background art of the present invention will be described by taking a hydraulic shovel shown in FIG. 5 as an example.

This hydraulic shovel comprises a crawler-type lower propelling body 1, an upper slewing body 2 mounted on the lower propelling body 1 slewably about an axis X extending in a direction perpendicular to the ground, and a working attachment (excavation attachment) 9 attached to the upper slewing body 2, wherein the working attachment 9 includes a boom 3, an arm 4, a bucket 5, and a plurality of hydraulic actuators for operating them, that is, a boom cylinder 6, an arm cylinder 7 and a bucket cylinder 8. The hydraulic shovel further comprises, as other hydraulic actuators, right and left travel motors for driving the lower propelling body 1 (right and left crawlers), and a slewing motor for slewing the upper slewing body 2.

In this type of hydraulic shovel, there can be required that the slewing movement of the upper slewing body 2 by the slewing motor and other movements by the hydraulic actuators other than the slewing motor is performed independently from each other. As means to ensure the independence, the following Patent Document 1 discloses: dividing a hydraulic circuit to be equipped in the hydraulic shovel into (i) a first circuit to which one of the right and left travel motors and the boom cylinder belong, (ii) a second circuit to which the other travel motor and the arm cylinder belong, and (iii) a third circuit to which the slewing motor belongs; and providing first, second and third pumps for driving the first, second and third circuits in a mutually independent manner.

Besides, this hydraulic circuit is further designed to ensure straight-traveling stability. Firstly, the travel motors included in respective first and second circuits are located on respective upstreammost sides with respect to respective flows of hydraulic fluid discharged from the first and second circuits, so that each of the first and second circuits is set as a circuit for prioritizing travelling. In other words, the first and second circuits are configured so as to give each of the travel motors a priority to be supplied with hydraulic fluid discharged from each of the first and second pumps during a double travel operation for simultaneously driving the two travel motors. Secondly, the hydraulic circuit includes a merging valve for merging hydraulic fluid discharged from the third pump toward the third circuit into a fluid passage leading to the actuator other than the travel motor, in each of the first and second circuits. This hydraulic circuit makes it possible to ensure a movement of each of the remaining hydraulic actuators other than the travel motors, while guaranteeing straight-traveling stability.

The hydraulic circuit includes a plurality of control valves for operating respective hydraulic actuators, wherein each of the control valves has a bleed-off passage. Thus, when the arm cylinder in the second circuit is not operated, i.e., when the control valve for operating the arm cylinder is in a neutral position thereof, the bleed-off passage of this control valve is communicated with a tank to thereby allow hydraulic fluid discharged from the third pump to flow into the tank via the second circuit, thus preventing a pumping pressure of the third pump from sufficient rise. This slows down the movement of each of the remaining hydraulic actuators such as a boom raising movement or a slewing movement. This, however, causes no problem because the above movements are to be performed during traveling; it is rather desirable in view of safety.

In the above conventional hydraulic circuit, the merging valve is adapted to merge hydraulic fluid discharged from the third pump into each of the first and second circuits, regardless of presence or absence of an operation on the two travel motors, and even also when a boom raising operation is performed, in the same manner as that when operations on the two travel motors and at least one of the remaining hydraulic actuators are performed. The conventional hydraulic circuit therefore has a problem that a sufficient pumping pressure cannot be obtained during the boom raising operation irrelevant to the travel operation, resulting in poor performance of the boom raising movement. Specifically, upon the boom raising operation with no operation of the arm cylinder in the second circuit, wherein the control valve for the arm cylinder is in the neutral position to communicate the bleed-off passage of this control valve with the tank, hydraulic fluid discharged from the third pump flows into the tank through the second circuit, thereby hindering the pumping pressure from sufficient rise. As measures against this problem, there can be performed providing an orifice in a merging passage extending from the third circuit to the second circuit to increase the pumping pressure; however, there are remarkable limitations on a rise of the pumping pressure by means of the orifice.

Besides, the conventional hydraulic circuit has a defect that the performance of both of the boom raising operation and the slewing operation deteriorates the slewing acceleration performance due to difficulty in raising pressure for slewing acceleration, in addition to the boom raising performance. Thus, there can be a problem that a cycle time of the work, for example, of loading the bucket with earth and sand and dumping it is extended to thereby deteriorate the work efficiency.

The conventional hydraulic circuit may be designed such that hydraulic fluid discharged from the third pump is merged into the first circuit via a path different from the merging valve, during the boom raising operation; however, such a design is inadvisable, because it involves an increase in complexity of a connection portion between the circuits of the first to third circuits and a need for a special valve, resulting in increased complexity of circuit configuration and increased cost.

LIST OF PRIOR ART DOCUMENTS

Patent Documents

Patent Document 1: JP 4137431B

SUMMARY OF THE INVENTION

It is an object of the present invention to provide a construction machine which comprises first to third circuits, first to third pumps corresponding to the first to third circuits respectively, and a merging valve for merging hydraulic fluid discharged from the third pump during driving of the right and left travel motors, wherein the construction machine is capable of ensuring a pumping pressure of the third pump, when boom raising operation is performed or boom raising operation and slewing operation are simultaneously performed, to improve the boom raising performance (in the latter operation, both of the boom raising and slewing performances), with no need for addition of a special valve different from the merging valve.

The present invention provides a first construction machine which comprises: a lower propelling body; an upper slewing body slewably mounted on the lower propelling body; a working attachment attached to the upper slewing body, wherein the working attachment includes a boom raisable and lowerable with respect to the upper slewing body, an arm swingable with respect to the boom, a boom cylinder which is a hydraulic actuator for driving the boom, and an arm cylinder which is a hydraulic actuator for driving the arm; right and left travel motors which are hydraulic actuators for driving the lower propelling body to make the lower propelling body travel; a slewing motor which is a hydraulic actuators for driving the upper slewing body to slew the upper slewing body; a hydraulic actuator circuit for operating the hydraulic actuators, the hydraulic actuator circuit including a first circuit connected to a first travel motor which is one of the right and left travel motors and to the boom cylinder, a second circuit connected to a second motor which is the other of the right and left travel motors and to the arm cylinder, and a third circuit connected to the slewing motor, and each of the first to third circuits having a control valve associated with a corresponding one of the hydraulic actuators to control an operation of the hydraulic actuator; a first pump for discharging hydraulic fluid toward the first circuit; a second pump for discharging hydraulic fluid toward the second circuit; and a third pump for discharging hydraulic fluid toward the third circuit, wherein: the first travel motor is disposed on an upstreammost side in the first circuit so as to give the first travel motor a priority to be driven; the second travel motor is disposed on an upstreammost side in the second circuit so as to give the second travel motor a priority to be driven; and the hydraulic actuator circuit further includes a first merging valve for merging hydraulic fluid discharged from the third pump toward the third circuit into each of the first and second circuits, the first merging valve having a first position for unloading the hydraulic fluid discharged from the third pump through the second circuit when none of the hydraulic actuators other than the first and second travel motors is operated, a second position for merging the hydraulic fluid discharged from the third pump into each of the first and second circuits when a double travel operation, which is an operation for simultaneously operating the first and second travel motors, and an operation on at least one of the remaining hydraulic actuators except for a boom raising operation which is an operation for raising the boom are performed, and a third position for merging the hydraulic fluid discharged from the third pump into the first circuit while blocking the hydraulic fluid from the second circuit when the boom raising operation is performed.

The present invention also provides a second construction machine which has the same fundamental configuration as that of the first construction machine, and comprises a second merging valve for merging hydraulic fluid discharged from the third pump toward the third circuit into each of the first and second circuits, instead of the first merging valve in the first construction machine. The second merging valve has a first position for unloading the hydraulic fluid discharged from the third pump through the second circuit when none of the hydraulic actuators other than the first and second travel motors is operated, a second position for merging the hydraulic fluid discharged from the third pump into each of the first and second circuits when a double travel operation, which is an operation for simultaneously operating the first and second travel motors, and an operation on at least one of the remaining hydraulic actuators except for a boom raising operation which is an operation for raising the boom are performed, and a third position for merging hydraulic fluid discharged from the third pump into the first circuit while blocked the hydraulic fluid from the second circuit only when both of the boom raising operation and a slewing operation by the slewing motor are performed.

DESCRIPTION OF EMBODIMENTS

Figure 1:
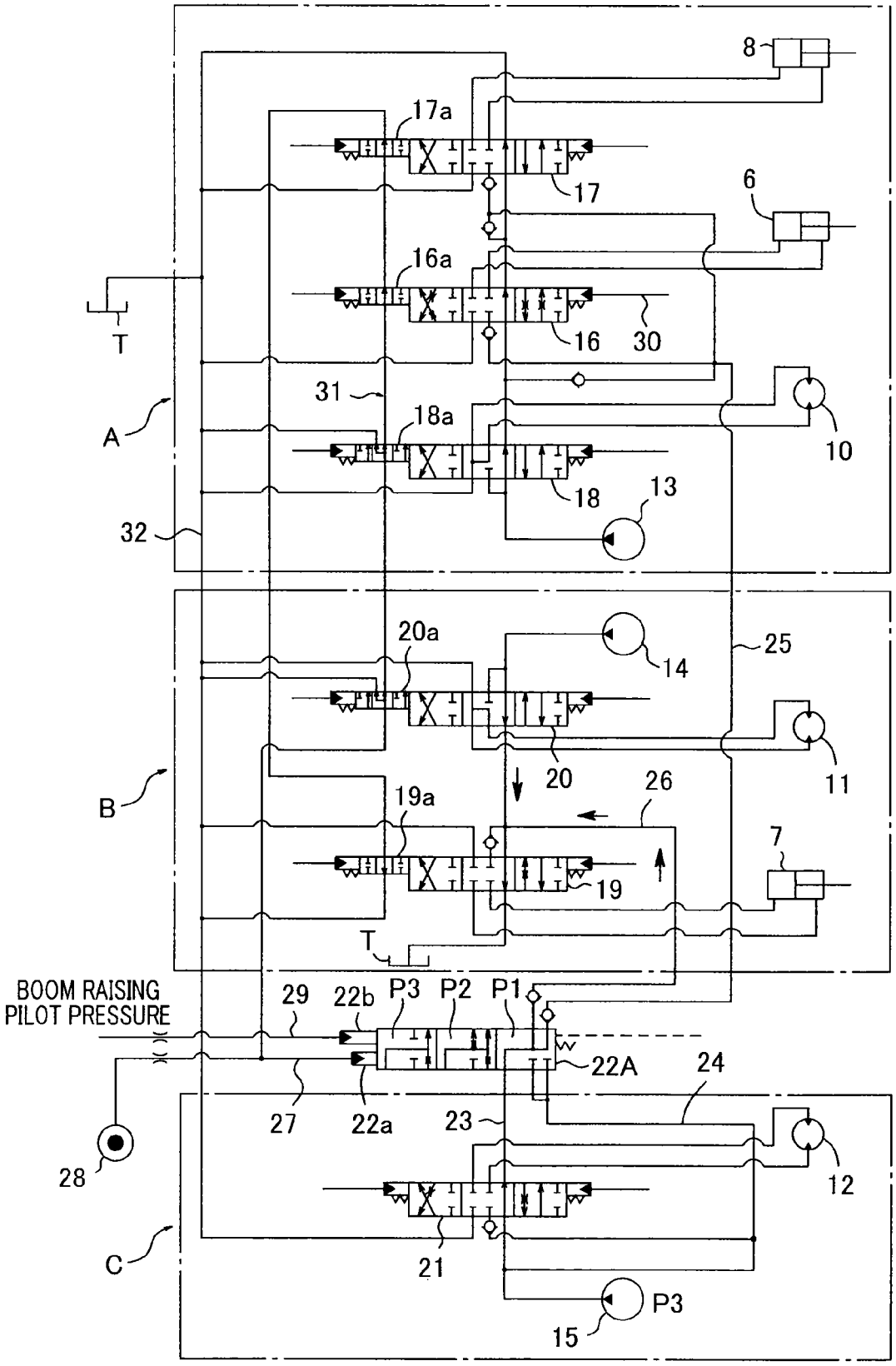
FIG. 1 is a diagram showing a hydraulic actuator circuit equipped in a hydraulic shovel according to a first embodiment of the present invention.
Figure 3:
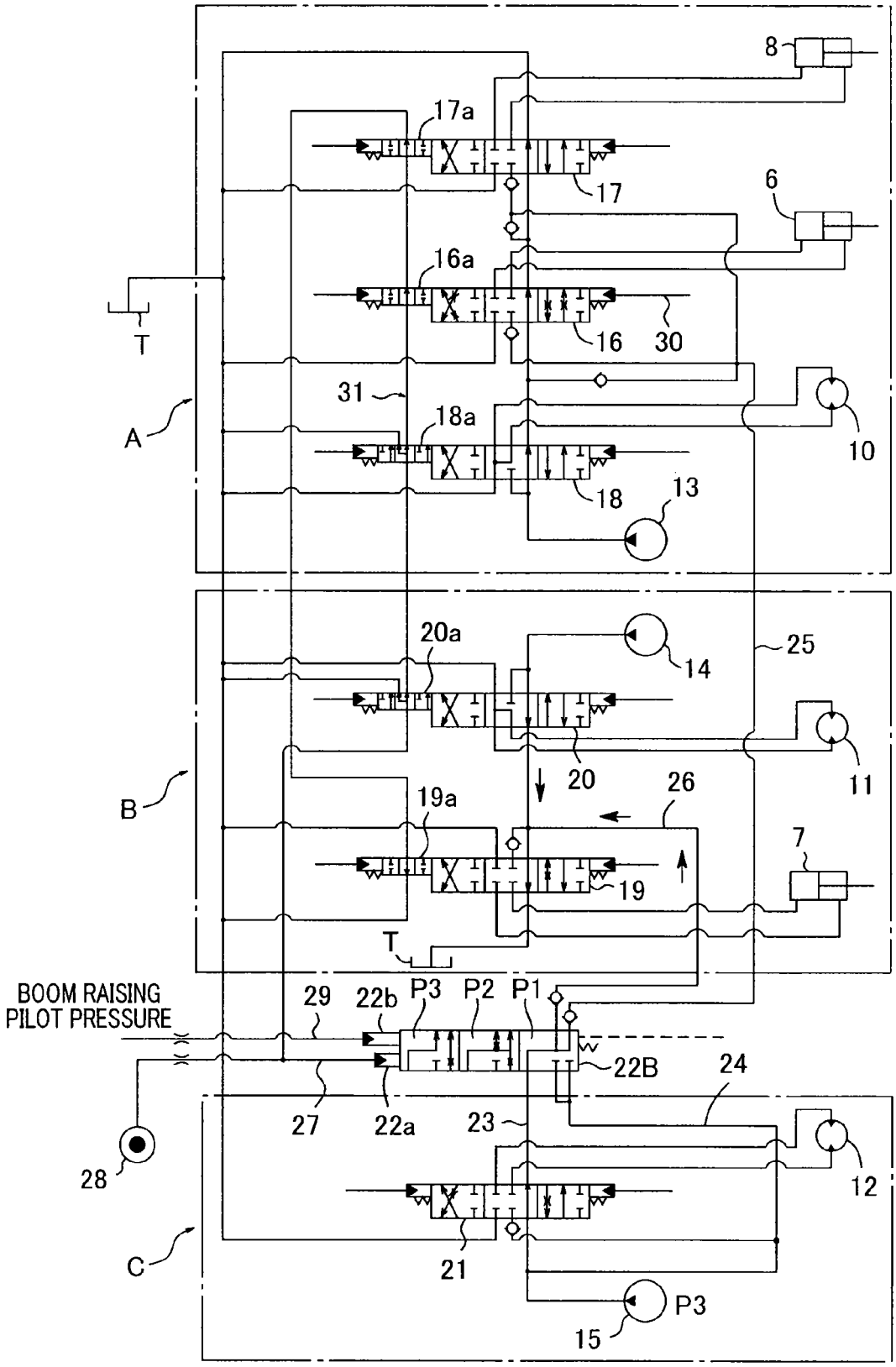
FIG. 3 is a diagram showing a hydraulic actuator circuit equipped in a hydraulic shovel according to a second embodiment of the present invention.

First and second embodiments of the present invention will be described with reference to the drawings. Both of the embodiments are designed for a hydraulic shovel shown in FIG. 5. As mentioned previously, this hydraulic shovel comprises a crawler-type lower propelling body 1, an upper slewing body 2 mounted on the lower propelling body 1 slewably about an axis X extending in a direction perpendicular to the ground, and a working attachment (excavation attachment) 9 attached to the upper slewing body 2, wherein the working attachment 9 includes a boom 3, an arm 4, a bucket 5, and a plurality of hydraulic actuators for operating them, namely, a boom cylinder 6, an arm cylinder 7 and a bucket cylinder 8. The hydraulic shovel further comprises, as other hydraulic actuators, a left travel motor 10, a right travel motor 11 and a slewing motor 12, as shown in FIGS. 1 and 3. The left and right travel motors 10, 11 are adapted to drive respective left and right crawlers of the lower propelling body 1 to make the lower propelling body 1 travel, and the slewing motor 12 is adapted to slew the upper slewing body 2. The above configuration is common in the first and second embodiments.

In the first embodiment, as a hydraulic circuit, a hydraulic actuator circuit shown in FIG. 1 is equipped in the hydraulic shovel. The hydraulic actuator circuit includes: a first circuit A connected to the left travel motor 10, the boom cylinder 6 and the bucket cylinder 8; a second circuit B connected to the right travel motor 11 and the arm cylinder 7; and a third circuit C connected to the slewing motor 12. Furthermore, the hydraulic shovel is equipped with a first pump 13 for discharging hydraulic fluid toward the first circuit A, a second pump 14 for discharging hydraulic fluid toward the second circuit B, and a third pump 15 for discharging hydraulic fluid toward the third circuit C.

Each of the first to third circuits A, B, C has at least one control valve associated with a corresponding one of the hydraulic actuators to control an actuation thereof. In this embodiment, each of the control valves is composed of a directional changeover valve including a hydraulic pilot operated-type spool valve. Specifically, the first circuit A includes respective three control valves 16, 17, 18 for the boom cylinder, the bucket cylinder and the left travel motor. The second circuit B includes respective two control valves 19, 20 for the arm cylinder and the right travel motor, and the third circuit C includes a control valve 21 for the slewing motor.

As shown in FIG. 1, in the first and second circuits A, B, the travel control valves 18, 20 are disposed on respective upstreammost sides in respective flow directions of hydraulic fluids discharged from the hydraulic pump 13, 14, respectively; whereby the first circuit A is configured as a travel priority circuit for supplying hydraulic fluid discharged from the first pump 13 prior to the left travel motor 10 when a travel operation is performed, and the first circuit B is configured as a travell priority circuit for supplying hydraulic fluid discharged from the second pump 14 prior to the right travel motor 11 when a travel operation is performed. Hence, in the case where an operation for supplying an entire pump discharge flow to each of the travel motors 10, 11 is performed during a double travel mode in which the two travel motors 10, 11 are simultaneously driven, the first and second circuits A and B allow no hydraulic fluid discharged from the first and second pumps 13, 14 to be supplied to the hydraulic actuators except the travel motors.

Therefore, in order to ensure a movement of each of the remaining hydraulic actuators during the double travelling mode, the hydraulic actuator circuit further comprises a merging valve (first merging valve) 22A. The merging valve 22A is operable to merge hydraulic fluid discharged from the third pump 15 (including the slewing motor 12) toward the third circuit C, during the double travelling mode, to each of the first and second circuits A, B, in the form of a tandem or parallel flow.

Additionally with reference to FIG. 2 enlargedly showing the merging valve 22A, the merging valve 22A will be described in detail.

The merging valve 22A is composed of a three-position pilot controlled selector valve having a first position P1, a second position P2 and a third position P3. The merging valve 22A includes a holding spring for elastically holding a spool of the merging valve in the first position as a neutral position, and first and second pilot ports 22*a*, 22*b* provided on a side opposite to the holding spring.

The merging valve 22A has three input ports: one of the input ports is connected to an unloading passage 23 leading from the third pump 15 to the merging valve 22A via a bleed-off passage to be opened in the slewing control valve 21 when the slewing control valve 21 is in a neutral position thereof; the others of the input ports is connected to a parallel passage 24 bypassing the slewing control valve 21. The merging valve 22A has respective two output ports connected to the first and second circuits A, B via respective two merging lines (hereinafter referred to as a "first merging line" and a "second merging line" respectively) 25, 26. The first merging line 25 are connected to the first circuit A to allow the hydraulic fluid to be merged into a primary side of the control valve (in this embodiment, the boom control valve 16) located on an immediately downstream side of the left travel control valve 18 in the first circuit A. Similarly, the second merging line 26 is connected to the second circuit B to allow the hydraulic fluid to be merged into a primary side of the control valve (in this embodiment, the arm control valve 19) located on an immediately downstream side of the right travel control valve 20 in the second circuit B.

The first pilot port 22*a* of the merging valve 22A makes up a merging selection pilot pressure input section for receiving an input of a merging selection pilot pressure, being connected to a pilot hydraulic pressure source 28 through a first pilot line 27. The first pilot line 27 and the pilot hydraulic pressure source 28 make up a pilot pressure input circuit for inputting the merging selection pilot pressure into the first pilot port 22*a*. The second pilot port 22*b* makes up a boom raising operation pilot pressure input section for receiving an input of a boom raising operation pilot pressure for a boom raising operation which is an operation for raising the boom 3, being connected to a boom raising pilot line 30 through a second pilot line 29. The boom raising pilot line 30 is connected to a boom raising-side pilot port of the boom cylinder control valve 16 to input the boom raising operation pilot pressure into the control valve 16.

The control valves 16 to 20 other than the slewing motor control valve 21 have respective side bypass sections 16*a*, 17*a*, 18*a*, 19*a*, 20*a*, and the hydraulic actuator circuit includes a side bypass line 31 serially connecting the side bypass sections 16*a* to 20*a*. The side bypass line 31 is equivalent to a pilot pressure input inhibition line which communicates the first pilot line 27 constituting the pilot pressure input circuit with a tank T when none of the hydraulic actuators 16 to 20 is operated, thereby inhibiting the input of the merging selection pilot pressure into the first pilot port 22*a*. The side bypass line 31 has one end connected to the first pilot line 27 for the merging valve 22A and the other end connected to a tank line 32 leading to the tank T. Each of the side bypass sections 16*a* to 20*a* is adapted to open the side bypass line 31 only when all of the control valves 16 to 20 are in respective neutral positions thereof. Accordingly, only when all of the side bypass sections 16*a* to 20*a* are opened, a supply of the merging selection pilot pressure into the first pilot port 22*a* of the merging valve 22A is inhibited.

Specifically, there is the following relationship between the opening/blocking of the side bypass line 31 and the position of the merging valve 22A.

i. When none of the hydraulic actuators is operated, or when only a double travel operation is performed, all of the side bypass sections 16*a* to 20*a* are set to open the side bypass line 31, so that the side bypass line 31 lets the merging selection pilot pressure output from the pilot hydraulic pressure source 28 to the tank T through the tank line 32, thereby inhibiting the merging selection pilot pressure from being input into the first pilot port 22*a* of the merging valve 22A. The merging valve 22A is thus held in the first position P1 which is a neutral position thereof.

ii. When the double travel operation and an operation for at least one of the remaining hydraulic actuators except for the boom raising operation are simultaneously performed, the side bypass sections of the control valves for the operated hydraulic actuators block the side bypass line 31, thereby permitting the merging selection pilot pressure to be input from the pilot hydraulic pressure source 28 into the first pilot port 22*a* of the merging valve 22A. The merging selection pilot pressure changes over the merging valve 22A to the second position P2 against a holding force, i.e., an elastic force, of the holding spring.

iii. When the boom raising operation is performed, regardless of presence or absence of the double travel operation, the boom raising pilot pressure is applied to the second pilot port 22*b* of the merging valve 22A to change over the merging valve 22A to the third position P3 against the holding force of the holding spring.

In the first position P1, the merging valve 22A blocks the parallel passage 24 and connects the unloading passage 23 to each of the first and second merging lines 25, 26. This allows hydraulic fluid discharged from the third pump 15 to be merged into each of the first and second circuits A, B through the first and second merging lines 25, 26, respectively. In this process, if there is no arm operation, the second merging line 26 is communicated with the tank T through a bleed-off passage of the arm cylinder control valve 19.

In the second position P2, the merging valve 22A connects the unloading passage 23 and the parallel passage 24 to each of the first and second merging lines 25, 26. This allows the hydraulic fluid discharged from the third pump 15 to pass through the unloading passage 23 and the parallel passage 24 and then be flowed into each of the first and second circuits A, B through the first and second merging lines 25, 26, respectively. This enables a movement of each of the actuators other than the travel motors 10, 11 during the double travelling mode to be ensured.

Figure 2:
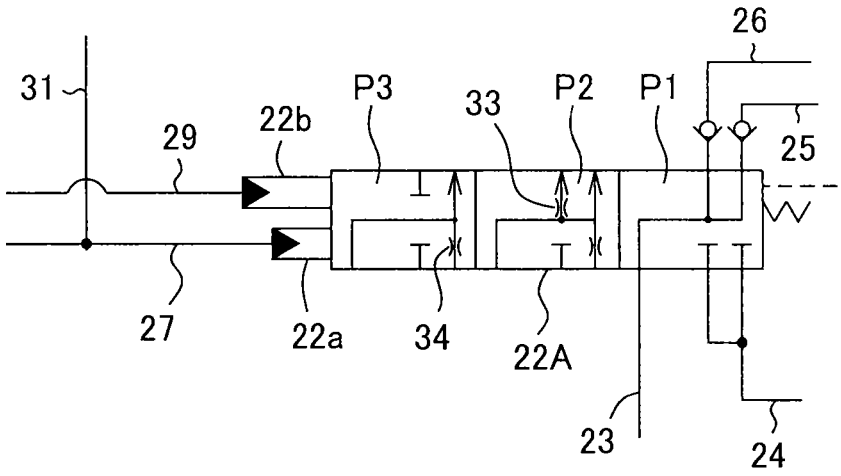
FIG. 2 is an enlarged diagram of a merging valve provided in the circuit shown in FIG. 1.

As for the second position P2, in order to allow the pumping pressure of the third pump 15 to rise even with no operation of the arm control valve 19, the merging valve 22A is provided with an orifice 33 in a passage thereof for merging hydraulic fluid from the third pump 15 into the second circuit B, as shown in FIG. 2.

In the third position P3, the merging valve 22A blocks the second merging line 26 and connects both of the unloading passage 23 and the parallel passage 24 to only the first merging line 25. This allows the hydraulic fluid discharged from the third pump 15 to pass through the unloading passage 23 and the parallel passage 24 and then be merged into only the first circuit A through the first merging line 25, while being blocked from the second circuit B. The pumping pressure of the third pump 15 is thus prevented from reduction to thereby enable a sufficient pressure for the boom raising operation and a sufficient pressure for slewing acceleration in a situation where the boom raising operation and the slewing operation are simultaneously performed to be ensured.

Furthermore, as for the third position P3, in order to make the pumping pressure of the third pump 15 be greater than a pressure (boom pressure) of the first circuit A, the merging valve 22A has an orifice 34 (see FIG. 2) provided in a passage thereof for merging the hydraulic fluid discharged from the third pump 15 into the first circuit A, and a balance between slewing acceleration performance and boom raising performance is thereby adjusted.

As above, the hydraulic actuator circuit in this embodiment has the merging valve 22A for merging hydraulic fluid discharged from the third pump 15 into each of the first and second circuits A, B when at least one of the remaining hydraulic actuators other than the two travel motors 10, 11 is operated during the double travelling mode in which the two travel motors 10, 11 are driven, and the merging valve 22A has the third position P3 for allowing the hydraulic fluid discharged from the third pump 15 to be merged into only the first circuit A while being blocked from the second circuit B, when the boom raising operation (including a combination operation of the boom raising operation and the slewing operation, that is, boom raising/slewing combination operation) is performed, regardless of presence or absence of the double travel operation; this makes it possible to ensure, during the boom raising operation or the boom raising/slewing combination operation, a sufficient pumping pressure (boom raising pressure, slewing acceleration pressure) of the third pump 15 for the operation, to thereby enhance the boom raising performance in the former case, or enhance both of the boom raising performance and the slewing acceleration performance in the latter case. This makes it possible to make the boom raising movement and/or the slewing movement faster to shorten a cycle time, for example, in the case where the boom raising operation or the boom raising/slewing combination operation is performed after loading the bucket with earth and sand, enabling work efficiency to be improved.

In addition, merging the hydraulic fluid from the third pump 15 into the first circuit A and blocking the hydraulic fluid from the second circuit B are achieved by adding the third position P3 to the merging valve 22A, with no need for addition of a special valve different from the merging valve; this enables the above advantageous effect to be realized while avoiding an increase in complexity of circuit configuration and an increase in cost.

Furthermore, the merging valve 22A in this embodiment has the orifice 34 which is provided in a merging passage for merging hydraulic fluid from the third pump 15 into the first circuit A when the merging valve 22A is in the third position P3, and the orifice 34 is adapted to restrict a flow rate of the hydraulic fluid so as to make the pumping pressure of the third pump 15 be greater than a pressure (boom pressure) of the first circuit A; this enables a slewing pressure during the boom raising/slewing combination operation to be increased to thereby improve the slewing acceleration performance.

Figure 4:
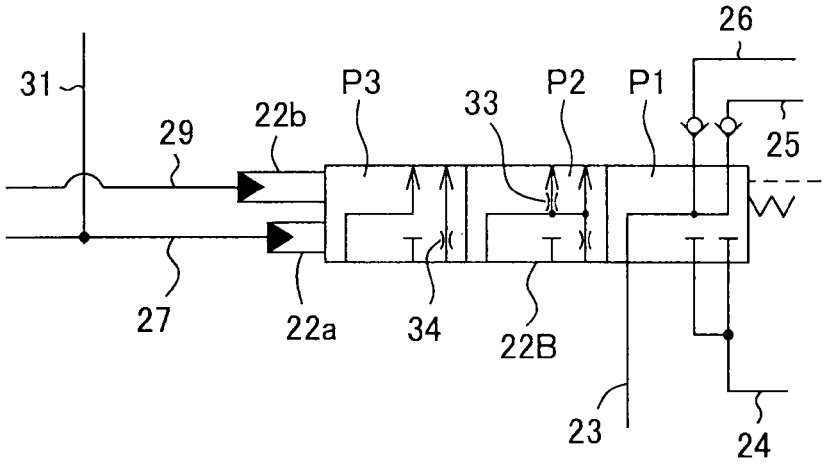
FIG. 4 is an enlarged diagram of a merging valve provided in the circuit shown in FIG. 3.

With reference to FIGS. 3 and 4, the second embodiment of the present invention will be described below.

Figure 5:
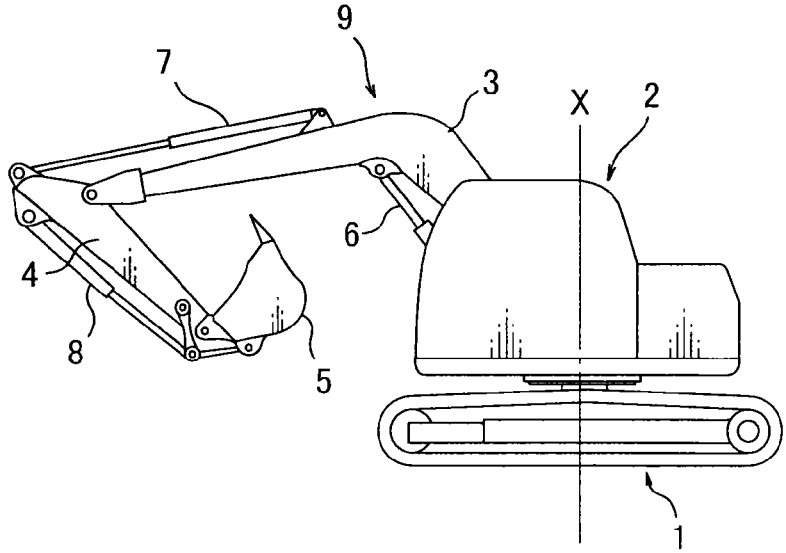
FIG. 5 is a schematic side view of a hydraulic shovel as an example of a subject of the present invention.

In the second embodiment, there is equipped a hydraulic actuator circuit as a hydraulic circuit, as shown in FIG. 3, in the hydraulic shovel shown in FIG. 5. This hydraulic actuator circuit is obtained by replacing the merging valve 22A (first merging valve) of the hydraulic actuator circuit in the first embodiment shown in FIG. 1 with a second second merging valve 22B (second merging valve) which is also shown in FIG. 4. In other words, the hydraulic actuator circuit in the second embodiment comprises a first circuit A, a second circuit B and a third circuit C which are identical to the first circuit A, the second circuit B and the third circuit C in the already-described first embodiment, respectively. The hydraulic shovel according to the second embodiment is also equipped with a first pump 13 for discharging hydraulic fluid toward the first circuit A, a second pump 14 for discharging hydraulic fluid toward the second circuit B, and a third pump 15 for discharging hydraulic fluid toward the third circuit C. Hence, in the following description, the same element or component as that in the first embodiment will be assigned with a common reference numeral or code, and its description will be omitted.

The merging valve 22B is composed of a three-position pilot controlled selector valve having a first position P1, a second position P2 and a third position P3. The merging valve 22B includes a holding spring for elastically holding a spool of the merging valve in the first position as a neutral position and first and second pilot ports 22*a*, 22*b* provided on a side opposite to the holding spring.

The merging valve 22B has three input ports: one of the input ports is connected to an unloading passage 23 leading from the third pump 15 to the merging valve 22B through a bleed-off passage to be opened in a slewing control valve 21 when the slewing control valve 21 is in a neutral position thereof, and the others of the input ports are connected to a parallel passage 24 bypassing the slewing control valve 21. The merging valve 22B has a first output port and a second output port connected to the first and second circuits A, B, respectively, through respective two merging lines (hereinafter referred to respectively as a "first merging line" and a "second merging line") 25, 26. The first merging line 25 is connected to the first circuit A so as to allow hydraulic fluid to be merged into a primary side of a control valve (in this embodiment, a boom control valve 16) located on an immediately downstream side of a left travel control valve 18 in the first circuit A. Likewise, the second merging line 26 is connected to the second circuit B so as to allow the hydraulic fluid to be merged into a primary side of a control valve (in this embodiment, an arm control valve 19) located on an immediately downstream side of a right travel control valve 20 in the second circuit B.

The first pilot port 22*a* of the merging valve 22B makes up a merging selection pilot pressure input section for receiving an input of a merging selection pilot pressure, being connected to a pilot hydraulic pressure source 28 via a first pilot line 27. The first pilot line 27 and the pilot hydraulic pressure source 28 make up a pilot pressure input circuit for inputting the merging selection pilot pressure into the first pilot port 22*a*. The second pilot port 22*b* makes up a boom raising operation pilot pressure input section for receiving an input of a boom raising operation pilot pressure for a boom raising operation which is an operation for raising the boom 3, being connected to a boom raising pilot line 30 through a second pilot line 29. The boom raising pilot line 30 is connected to a boom raising-side pilot port of the boom cylinder control valve 16 to input the boom raising operation pilot pressure into the control valve 16.

The control valves 16 to 20 other than the slewing motor control valve 21 have respective side bypass sections 16*a*, 17*a*, 18*a*, 19*a*, 20*a*, and the hydraulic actuator circuit includes a side bypass line 31 serially connecting the side bypass sections 16*a* to 20*a*. The side bypass line 31 is equivalent to a pilot pressure input inhibition line for communicating the first pilot line 27 constituting the pilot pressure input circuit with a tank T when none of the hydraulic actuators 16 to 20 is operated, thereby inhibiting the input of the merging selection pilot pressure into the first pilot port 22*a*. The side bypass line 31 has one end connected to the first pilot line 27 of the merging valve 22B and the other end connected to a tank line 32 leading to the tank T. Each of the side bypass sections 16*a* to 20*a* is adapted to open the side bypass line 31 only when corresponding one of the control valves 16 to 20 is in a neutral position thereof, so that, a supply of the merging selection pilot pressure into the first pilot port 22*a* of the merging valve 22B is inhibited only when all of the side bypass sections 16*a* to 20 *a* are opened.

Specifically, there is the following relationship between the opening/blocking of the side bypass line 31 and the position of the merging valve 22B.

i. Firstly, when none of the hydraulic actuators is operated, or when only the double travel operation is performed, all of the side bypass sections 16*a* to 20*a* are set to open the side bypass line 31; therefore, the side bypass line 31 lets the merging selection pilot pressure output from the pilot hydraulic pressure source 28 to the tank T through the tank line 32, thereby inhibiting the merging selection pilot pressure from being input into the first pilot port 22*a* of the merging valve 22B. The merging valve 22B is thus held in the first position P1 which is a neutral position thereof.

ii. When the double travel operation and an operation for at least one of the remaining hydraulic actuators other than the travel motors except for the boom raising operation are simultaneously performed, the side bypass sections of the control valves for the operated hydraulic actuators block the side bypass line 31, thereby permitting the merging selection pilot pressure to be input from the pilot hydraulic pressure source 28 into the first pilot port 22*a* of the merging valve 22B. The merging selection pilot pressure changes over the merging valve 22B to the second position P2 against a holding force, i.e., an elastic force, of the holding spring.

iii. When the boom raising operation is performed, regardless of presence or absence of the double travel operation, the boom raising pilot pressure is applied to the second pilot port 22*b* of the merging valve 22B to change over the merging valve 22B to the third position P3 against the holding force of the holding spring.

In the first position P1, the merging valve 22B blocks the parallel passage 24 and connects the unloading passage 23 to each of the first and second merging lines 25, 26. This allows the hydraulic fluid discharged from the third pump 15 to be merged into each of the first and second circuits A, B through the first and second merging lines 25, 26, respectively. In this process, if there is no arm operation, the second merging line 26 is communicated with the tank T through a bleed-off passage of the arm cylinder control valve 19.

In the second position P2, the merging valve 22B connects the unloading passage 23 and the parallel passage 24 to each of the first and second merging lines 25, 26. This allows the hydraulic fluid discharged from the third pump 15 to pass through the unloading passage 23 and the parallel passage 24 and then be flowed into each of the first and second circuits A, B through the first and second merging lines 25, 26, respectively. This enables a movement of each of the actuators other than the travel motors 10, 11 during the double travelling mode to be ensured.

As for the second position P2, in order to allow the pumping pressure of the third pump 15 to rise even with no operation of the arm control valve 19, the merging valve 22B is provided with an orifice 33 in a passage thereof for merging hydraulic fluid from the third pump 15 into the second circuit B, as shown in FIG. 4.

In the third position P3, the merging valve 22B connects the unloading passage 23 to only the second merging line 26, and connects the parallel passage 24 to only the first merging line 25. This allows hydraulic fluid discharged from the third pump 15 to be merged into the first circuit A through the unloading passage 23 and then via the first merging line 25, and merged into the second circuit B through the unloading passage 23 and then via the second merging line 26. Meanwhile, since the second merging line 26 is communicated with the tank T through the arm cylinder control valve 19 when the arm cylinder 7 is not operated, the entire hydraulic fluid discharged from the third pump 15 is unloaded and also inhibited from flowing to the first circuit A.

In the case where a slewing operation is performed when the merging valve 22B is in the third position P3, that is, in the case of performing a boom raising/slewing combination operation, the slewing control valve 21 is operated to block a bleed-off passage thereof, thereby cutting off the third pump 15 from the unloading passage 23, i.e., from the tank T. This blocking/cutoff causes the hydraulic fluid discharged from the third pump 15 to be sent to the slewing motor 12 of the third circuit C and the first circuit A, in parallel. The pumping pressure of the third pump 15 is thus prevented from a reduction, and a sufficient pressure for the boom raising operation and slewing acceleration during the boom raising/slewing combination operation is secured.

Furthermore, as for the third position P3, in order to make the pumping pressure of the third pump 15 be greater than a pressure of the first circuit A (i.e. boom pressure), the merging valve 22B is provided with an orifice 34 (see FIG. 4) in a passage thereof for merging hydraulic fluid from the third pump 15 into the first circuit A, and the balance between slewing acceleration performance and boom raising performance is thereby adjusted.

As above, the hydraulic actuator circuit in this embodiment has the merging valve 22B for merging hydraulic fluid discharged from the third pump 15 into each of the first and second circuits A, B when at least one of the remaining hydraulic actuators other than the two travel motors 10, 11 is operated during the double travelling mode in which the two travel motors 10, 11 are driven, and the merging valve 22B has the third position P3 for allowing the hydraulic fluid discharged from the third pump 15 to be merged into only the first circuit A while being blocked from the second circuit B, when the boom raising operation (including a combination operation of the boom raising operation and the slewing operation, that is, boom raising/slewing combination operation) is performed, regardless of presence or absence of the double travel operation; this makes it possible to ensure, during the boom raising operation or the boom raising/slewing combination operation, a sufficient pumping pressure (boom raising pressure, slewing acceleration pressure) of the third pump 15 for the operation, to thereby enhance the boom raising performance in the former case, or enhance both of the boom raising performance and the slewing acceleration performance in the latter case. This makes it possible to make the boom raising movement and/or the slewing movement faster to shorten a cycle time, for example, in the case where the boom raising operation or the boom raising/slewing combination operation is performed after loading the bucket with earth and sand, enabling work efficiency to be improved.

In addition, merging the hydraulic fluid from the third pump 15 into the first circuit A and blocking the hydraulic fluid from the second circuit B are achieved by adding the third position P3 to the merging valve 22A, with no need for addition of a special valve different from the merging valve; this enables the above advantageous effect to be realized while avoiding an increase in complexity of circuit configuration and an increase in cost.

Furthermore, merging the hydraulic fluid from the third pump 15 into the first circuit A (specifically, into a boom cylinder 6) is performed only during the boom raising/slewing combination operation, not performed when only the boom raising operation is performed; this prevents the combination operation of the boom raising operation and an operation on each of the hydraulic actuators other than the boom cylinder from causing a disadvantage of conflict in sharing a discharge flow of the third pump 15 to thereby deteriorate operability.

Particularly, in the second embodiment, when the merging valve 22 is changed over to the third position P3, the slewing control valve 21 is activated to block the bleed-off passage thereof to thereby cut off a communication of the third pump 15 and the second circuit B with each other, thus allowing the configuration of a pilot system to be simplified, for example, as compared to the case of introducing both of a pilot pressure for the boom raising operation and a pilot pressure for the slewing operation into the merging valve 22B to thereby change over the merging valve 22B to the third position P3 and cutting off the communication between the third pump 15 and the second circuit B by the merging valve 22B changed over to the above third position.

Furthermore, the merging valve 22B in this embodiment has the orifice 34 which is provided in a merging passage for merging hydraulic fluid from the third pump 15 into the first circuit A when the merging valve 22A is in the third position P3, and the orifice 34 is adapted to restrict a flow rate of the hydraulic fluid so as to make the pumping pressure of the third pump 15 be greater than a pressure (boom pressure) of the first circuit A; this enables a slewing pressure during the boom raising/slewing combination operation to be increased to thereby improve the slewing acceleration performance.

In the present invention, the second circuit B in the above embodiments may be additionally provided with a hydraulic actuator other than the aforementioned hydraulic actuators (e.g., an auxiliary service actuator) in parallel.

The construction machine of the present invention is not limited to a hydraulic shovel. The present invention can be applied to any other suitable construction machine, such as a crushing machine or a dismantling machine, for example, including a machine body consisting of various components of a hydraulic shovel other than a bucket, and a breaker or an opening/closing-type crusher attached to the machine body in place of the bucket.

As described above, according to the present invention, there is provided a construction machine which comprises: a lower propelling body; an upper slewing body slewably mounted on the lower propelling body; a working attachment attached to the upper slewing body, the working attachment including a boom raisable and lowerable with respect to the upper slewing body, an arm swingable with respect to the boom, a boom cylinder which is a hydraulic actuator for driving the boom, and an arm cylinder which is a hydraulic actuator for driving the arm; right and left travel motors which are hydraulic actuators for driving the lower propelling body to make the lower propelling body travel; a slewing motor which is a hydraulic actuators for driving the upper slewing body to slew the upper slewing body; a hydraulic actuator circuit for operating the hydraulic actuators, the hydraulic actuator circuit including a first circuit connected to a first travel motor which is one of the right and left travel motors and to the boom cylinder, a second circuit connected to a second motor which is the other of the right and left travel motors and to the arm cylinder, and a third circuit connected to the slewing motor, and each of the first to third circuits having a control valve associated with a corresponding one of the hydraulic actuators to control an operation of the hydraulic actuator; a first pump for discharging hydraulic fluid toward the first circuit; a second pump for discharging hydraulic fluid toward the second circuit; and a third pump for discharging hydraulic fluid toward the third circuit. In this construction machine, the first travel motor is disposed on an upstreammost side in the first circuit so as to give the first travel motor a priority to be driven; the second travel motor is disposed on an upstreammost side in the second circuit so as to give the second travel motor a priority to be driven.

Furthermore, in the first construction machine provided by the present invention, the hydraulic actuator circuit further includes a first merging valve for merging the hydraulic fluid discharged from the third pump toward the third circuit into each of the first and second circuits, and the first merging valve has a first position for unloading the hydraulic fluid discharged from the third pump through the second circuit when none of the hydraulic actuators other than the first and second travel motors is operated, a second position for merging the hydraulic fluid discharged from the third pump into each of the first and second circuits when a double travel operation, which is an operation for simultaneously operating the first and second travel motors, and an operation on at least one of the remaining hydraulic actuators except for a boom raising operation which is an operation for raising the boom are performed, and a third position for merging the hydraulic fluid discharged from the third pump into the first circuit while blocking the hydraulic fluid from the second circuit when the boom raising operation is performed.

Furthermore, in the first construction machine provided by the present invention, the hydraulic actuator circuit further includes a first merging valve for merging the hydraulic fluid discharged from the third pump toward the third circuit into each of the first and second circuits, and the first merging valve has a first position for unloading the hydraulic fluid discharged from the third pump through the second circuit when none of the hydraulic actuators other than the first and second travel motors is operated, a second position for merging the hydraulic fluid discharged from the third pump into each of the first and second circuits when a double travel operation, which is an operation for simultaneously operating the first and second travel motors, and an operation on at least one of the remaining hydraulic actuators except for a boom raising operation which is an operation for raising the boom are performed, and a third position for merging the hydraulic fluid discharged from the third pump into the first circuit while blocking the hydraulic fluid from the second circuit when the boom raising operation is performed.

A second construction machine provided by the present invention, while having the same fundamental configuration as that of the first construction machine, comprises, instead of the merging valve in the first construction machine, a merging valve adapted to the merge hydraulic fluid discharged from the third pump toward the third circuit into each of the first and second circuits and having a first position for unloading the hydraulic fluid discharged from the third pump through the second circuit when none of the hydraulic actuators other than the first and second travel motors is operated, a second position for merging the hydraulic fluid discharged from the third pump into each of the first and second circuits when a double travel operation, which is an operation for simultaneously operating the first and second travel motors, and an operation on at least one of the remaining hydraulic actuators except for a boom raising operation which is an operation for raising the boom are performed, and a third position for merging hydraulic fluid discharged from the third pump into the first circuit while blocked the hydraulic fluid from the second circuit only when both of the boom raising operation and a slewing operation by the slewing motor are performed.

The merging valve in the second construction machine, adapted to merge the hydraulic fluid discharged from the third pump into each of the first and second circuits when at least one of the remaining hydraulic actuators other than the front and rear travel motors is operated during the double travelling mode in which the two travel motors are driven and further adapted to allow the hydraulic fluid discharged from the third pump to be merged into the first circuit while blocking the hydraulic fluid from the second circuit, in the third position, during the boom raising/slewing combination operation, regardless of presence or absence of the double travel operation, enables a pumping pressure of the third pump to be secured when the boom raising/slewing combination operation, thus enhancing boom raising performance and slewing acceleration performance during the boom raising/slewing combination operation to improve work efficiency. In addition, merging the hydraulic fluid from the third pump into the first circuit and blocking the hydraulic fluid from the second circuit are achieved by adding the third position to the merging valve; this eliminates a need for adding a special valve different from the merging valve and thus allows the above advantageous effect to be realized while avoiding an increase in complexity of circuit configuration and an increase in cost.

In addition, merging the hydraulic fluid from the third pump into the first circuit is performed only during the boom raising/slewing combination operation, not performed when only the boom raising operation is performed; this prevents the combination operation of the boom raising operation and an operation on each of the hydraulic actuators other than the boom cylinder from causing a disadvantage of conflict in sharing a discharge flow of the third pump to thereby deteriorate operability.

It is preferable that: the control valve for an operation on the slewing motor, which is a slewing control valve, has a bleed-off passage for introducing hydraulic fluid discharged from the third pump to the merging valve when the slewing control valve is in a neutral position thereof; the third circuit includes an unloading passage leading from the third pump to the merging valve through the bleed-off passage of the slewing control valve, and a parallel passage leading from the third pump to the merging valve while bypassing the slewing control valve; the merging valve has a plurality of input ports connected to the unloading passage and the parallel passage respectively, a first output port connected to the first circuit through a first merging line, and a second output port connected to the second circuit through a second merging line; and the merging valve is adapted to connect the first merging line to the parallel passage and connect the second merging line to the unloading passage, in the third position.

The slewing control valve, thus activated, when the merging valve is changed over to the third position, to block the bleed-off passage and cut off a communication between the third pump and the second circuit, allows the configuration of a pilot system to be simplified, for example, as compared to the case of introducing both of a pilot pressure for the boom raising operation and a pilot pressure for the slewing operation into the merging valve to thereby change over the merging valve to the third position P3 and cutting off the communication between the third pump and the second circuit.

The merging valve preferably has an orifice provided in a passage for merging the hydraulic fluid from the third pump into the first circuit when the merging valve is in the third position, the orifice adapted to restrict a flow rate of hydraulic fluid in the passage so as to make a pumping pressure of the third pump be greater than a pressure of the first circuit. This orifice makes it possible to increase a slewing pressure during the boom raising/slewing combination operation to thereby further improve the slewing acceleration performance.

The merging valve in each of the first and second construction machine can be composed of a pilot controlled selector valve including a holding spring for holding the merging valve in the first position by a predetermined holding force thereof and a pilot portion for externally receiving a pilot pressure. In this case, the pilot portion may be adapted to receive an input of a pilot pressure which changes over the merging valve to the second position against the holding force of the holding spring, when the double travel operation which is an operation for simultaneously operating the first and second travel motors, and the operation on at least one of the remaining hydraulic actuators, except for the boom raising operation which is an operation for raising the boom, are performed, and to receive an input of a pilot pressure which changes over the merging valve to the third position against the holding force of the holding spring, when the boom raising operation is performed. This enables the position of the merging valve to be adequately changed.

Specifically, it is preferable that the pilot portion includes a merging selection pilot pressure input section for receiving an input of a merging selection pilot pressure which changes over the merging valve to the second position against the holding force of the holding spring and a boom raising operation pilot pressure input section for receiving an input of a boom raising operation pilot pressure which is input into the control valve for the boom cylinder so as to change over the merging valve to the third position against the holding force of the holding spring when the boom raising operation is performed, and the hydraulic actuator circuit further includes a pilot pressure input circuit for inputting the merging selection pilot pressure into the merging selection pilot pressure input section, and a pilot pressure input inhibition line for communicating the pilot pressure input circuit with a tank when none of the hydraulic actuators other than the first and second travel motors is operated to thereby inhibit the merging selection pilot pressure from being input into the merging selection pilot pressure input section. The pilot portion, the pilot pressure input circuit and the pilot pressure input inhibition line make it possible to change over the merging valve to the third position during the boom raising operation, in addition to the first and second positions, with a simple configuration utilizing the boom raising operation pilot pressure which is input into the control valve for the boom cylinder.

What is claimed is:

1. A construction machine comprising:

a lower propelling body;

an upper slewing body slewably mounted on the lower propelling body;

a working attachment attached to the upper slewing body, the working attachment including a boom raisable and lowerable with respect to the upper slewing body, an arm swingable with respect to the boom, a boom cylinder which is a hydraulic actuator for driving the boom, and an arm cylinder which is a hydraulic actuator for driving the arm;

right and left travel motors which are hydraulic actuators for driving the lower propelling body to make the lower propelling body travel;

a slewing motor which is a hydraulic actuators for driving the upper slewing body to slew the upper slewing body;

a hydraulic actuator circuit for operating the hydraulic actuators, the hydraulic actuator circuit including a first circuit connected to a first travel motor which is one of the right and left travel motors and to the boom cylinder, a second circuit connected to a second motor which is the other of the right and left travel motors and to the arm cylinder, and a third circuit connected to the slewing motor, and each of the first to third circuits having a control valve associated with a corresponding one of the hydraulic actuators to control an operation of the hydraulic actuator;

a first pump for discharging hydraulic fluid toward the first circuit;

a second pump for discharging hydraulic fluid toward the second circuit;

and a third pump for discharging hydraulic fluid toward the third circuit, wherein:

the first travel motor is disposed on an upstreammost side in the first circuit so as to give the first travel motor a priority to be driven;

the second travel motor is disposed on an upstreammost side in the second circuit so as to give the second travel motor a priority to be driven; and the hydraulic actuator circuit further includes a merging valve for merging hydraulic fluid discharged from the third pump toward the third circuit into each of the first and second circuits, the first merging valve having a first position for unloading the hydraulic fluid discharged from the third pump through the second circuit when none of the hydraulic actuators other than the first and second travel motors is operated, a second position for merging the hydraulic fluid discharged from the third pump into each of the first and second circuits when a double travel operation, which is an operation for simultaneously operating the first and second travel motors, and an operation on at least one of the remaining hydraulic actuators except for a boom raising operation which is an operation for raising the boom are performed, and a third position for merging the hydraulic fluid discharged from the third pump into the first circuit while blocking the hydraulic fluid from the second circuit when the boom raising operation is performed.

2. The construction machine as defined in claim 1, wherein the merging valve has an orifice which is provided in a merging passage for merging hydraulic fluid from the third pump into the first circuit when the merging valve is in the third position, the orifice being adapted to restrict a flow rate of hydraulic fluid in the merging passage so as to make a pumping pressure of the third pump be greater than a pressure of the first circuit.

3. The construction machine as defined in claim 1, wherein the merging valve is composed of a pilot controlled selector valve including a holding spring for holding the merging valve in the first position by a predetermined holding force thereof and a pilot portion for externally receiving a pilot pressure, the pilot portion adapted to receive an input of a pilot pressure which changes over the merging valve to the second position against the holding force of the holding spring, when the double travel operation which is an operation for simultaneously operating the first and second travel motors, and the operation on at least one of the remaining hydraulic actuators except for the boom raising operation which is an operation for raising the boom are performed, and to receive an input of a pilot pressure which changes over the merging valve to the third position against the holding force of the holding spring, when the boom raising operation is performed.

4. The construction machine as defined in claim 3, wherein: the pilot portion of the merging valve includes a merging selection pilot pressure input section for receiving an input of a merging selection pilot pressure which changes over the merging valve to the second position against the holding force of the holding spring and a boom raising operation pilot pressure input section for receiving an input of a boom raising operation pilot pressure which is input into the control valve for the boom cylinder so as to change over the merging valve to the third position against the holding force of the holding spring when the boom raising operation is performed, and the hydraulic actuator circuit further includes a pilot pressure input circuit for inputting the merging selection pilot pressure into the merging selection pilot pressure input section; and a pilot pressure input inhibition line for communicating the pilot pressure input circuit with a tank when none of the hydraulic actuators other than the first and second travel motors is operated to thereby inhibit the merging selection pilot pressure from being input into the merging selection pilot pressure input section.

5. A construction machine comprising:

a lower propelling body;

an upper slewing body slewably mounted on the lower propelling body;

a working attachment attached to the upper slewing body, the working attachment including a boom raisable and lowerable with respect to the upper slewing body, an arm swingable with respect to the boom, a boom cylinder which is a hydraulic actuator for driving the boom, and an arm cylinder which is a hydraulic actuator for driving the arm;

right and left travel motors which are hydraulic actuators for driving the lower propelling body to make the lower propelling body travel;

a slewing motor which is a hydraulic actuators for driving the upper slewing body to slew the upper slewing body;

a hydraulic actuator circuit for operating the hydraulic actuators, the hydraulic actuator circuit including a first circuit connected to a first travel motor which is one of the right and left travel motors and to the boom cylinder, a second circuit connected to a second motor which is the other of the right and left travel motors and to the arm cylinder, and a third circuit connected to the slewing motor, and each of the first to third circuits having a control valve associated with a corresponding one of the hydraulic actuators to control an operation of the hydraulic actuator;

a first pump for discharging hydraulic fluid toward the first circuit;

a second pump for discharging hydraulic fluid toward the second circuit;

and a third pump for discharging hydraulic fluid toward the third circuit, wherein:

the first travel motor is disposed on an upstreammost side in the first circuit so as to give the first travel motor a priority to be driven;

the second travel motor is disposed on an upstreammost side in the second circuit so as to give the second travel motor a priority to be driven; and the hydraulic actuator circuit further includes a merging valve for merging hydraulic fluid discharged from the third pump toward the third circuit into each of the first and second circuits, the merging valve having a first position for unloading the hydraulic fluid discharged from the third pump through the second circuit when none of the hydraulic actuators other than the first and second travel motors is operated, a second position for merging the hydraulic fluid discharged from the third pump into each of the first and second circuits when a double travel operation, which is an operation for simultaneously operating the first and second travel motors, and an operation on at least one of the remaining hydraulic actuators except for a boom raising operation which is an operation for raising the boom are performed, and a third position for merging hydraulic fluid discharged from the third pump into the first circuit while blocked the hydraulic fluid from the second circuit only when both of the boom raising operation and a slewing operation by the slewing motor are performed.

6. The construction machine as defined in claim 5, wherein: the control valve for an operation on the slewing motor, which is a slewing control valve, has a bleed-off passage for introducing hydraulic fluid discharged from the third pump to the merging valve when the slewing control valve is in a neutral position thereof; the third circuit includes an unloading passage leading from the third pump to the merging valve through the bleed-off passage of the slewing control valve, and a parallel passage leading from the third pump to the merging valve while bypassing the slewing control valve; the merging valve has a plurality of input ports connected to the unloading passage and the parallel passage respectively, a first output port connected to the first circuit through a first merging line, and a second output port connected to the second circuit through a second merging line; and the merging valve is adapted to connect the first merging line to the parallel passage and connect the second merging line to the unloading passage, in the third position.

7. The construction machine as defined in claim 5, wherein the merging valve has an orifice which is provided in a merging passage for merging the hydraulic fluid from the third pump into the first circuit when the merging valve is in the third position, the orifice being adapted to restrict a flow rate of hydraulic fluid in the merging passage so as to make a pumping pressure of the third pump be greater than a pressure of the first circuit.

8. The construction machine as defined in claim 5, wherein the merging valve is composed of a pilot controlled selector valve including a holding spring for holding the merging valve in the first position by a predetermined holding force thereof and a pilot portion for externally receiving a pilot pressure, the pilot portion adapted to receive an input of a pilot pressure which changes over the merging valve to the second position against the holding force of the holding spring, when the double travel operation which is an operation for simultaneously operating the first and second travel motors, and the operation on at least one of the remaining hydraulic actuators except for the boom raising operation which is an operation for raising the boom are performed, and to receive an input of a pilot pressure which changes over the merging valve to the third position against the holding force of the holding spring when the boom raising operation is performed.

9. The construction machine as defined in claim 8, wherein: the pilot portion of the merging valve includes a merging selection pilot pressure input section for receiving an input of a merging selection pilot pressure which changes over the merging valve to the second position against the holding force of the holding spring and a boom raising operation pilot pressure input section for receiving an input of a boom raising operation pilot pressure which is input into the control valve for the boom cylinder so as to change over the merging valve to the third position against the holding force of the holding spring when the boom raising operation is performed, and the hydraulic actuator circuit further includes a pilot pressure input circuit for inputting the merging selection pilot pressure into the merging selection pilot pressure input section, and a pilot pressure input inhibition line for communicating the pilot pressure input circuit with a tank when none of the hydraulic actuators other than the first and second travel motors is operated to thereby inhibit the merging selection pilot pressure from being input into the merging selection pilot pressure input section.

* * * * *